US011311110B1

(12) United States Patent
McDade

(10) Patent No.: US 11,311,110 B1
(45) Date of Patent: Apr. 26, 2022

(54) CAMP BUNK BED

(71) Applicant: Michael McDade, Anchorage, AK (US)

(72) Inventor: Michael McDade, Anchorage, AK (US)

( * ) Notice: Subject to any disclaimer, the term of this patent is extended or adjusted under 35 U.S.C. 154(b) by 573 days.

(21) Appl. No.: 15/244,351

(22) Filed: Aug. 23, 2016

Related U.S. Application Data

(60) Provisional application No. 62/240,135, filed on Oct. 12, 2015.

(51) Int. Cl.
*A47C 19/20* (2006.01)
*A47C 17/64* (2006.01)

(52) U.S. Cl.
CPC ..... *A47C 19/20* (2013.01); *A47C 17/645* (2013.01)

(58) Field of Classification Search
CPC ..... A47C 19/02; A47C 19/021; A47C 19/028; A47C 17/64; A47C 17/645; A47C 19/20; A47C 19/202; A47D 7/00; A47D 7/002; A47D 7/005; A47D 7/007; A47D 7/01; A47D 7/04
See application file for complete search history.

(56) References Cited

U.S. PATENT DOCUMENTS 1,396,208 A * 11/1921 Hubbard ..... A61G 1/013 5/114
2,119,387 A * 5/1938 Harvey ..... A47D 7/002 297/440.11
3,426,367 A * 2/1969 Bradford ..... A47C 17/645 403/108
4,858,349 A * 8/1989 Walsh ..... D06C 3/04 160/380
5,109,556 A * 5/1992 Cook ..... A47C 19/005 5/110

FOREIGN PATENT DOCUMENTS

CH 374463 A * 1/1964 ..... A47C 19/20

* cited by examiner

*Primary Examiner* — David R Hare
*Assistant Examiner* — Amanda L Bailey
(74) *Attorney, Agent, or Firm* — Michael J. Tavella

(57) ABSTRACT

The invention is a portable, easy to assembly camp bunk bed. The invention has a bunk frame system that is designed to be used with any camp cot bed The basic system features 2 frame assemblies, each frame assembly consists of 2 vertical stanchions and 2 lateral support rods. The vertical stanchions each have two cot bed support blocks with longitudinal support pins installed. Lateral support rods are used to secure the vertical stanchions together. In one style, the frame is secured with hook and loop type fastener straps. In the preferred style, the straps are replaced with a new fastening system for the cot using threaded posts and knobs. The cot is also modified so that it is designed specifically for the preferred bunk bed system. Finally, adapter posts are used to allow the bunk bed to be converted to a singe cot, if desired.

14 Claims, 18 Drawing Sheets

CAMP BUNK BED

CROSS REFERENCE TO RELATED APPLICATIONS

This application claims benefit of Provisional application 62/240,135 filed Oct. 12, 2015.

STATEMENT REGARDING FEDERALLY SPONSORED RESEARCH AND DEVELOPMENT

Not Applicable

BACKGROUND OF THE INVENTION

1. Field of the Invention

This invention relates to camp beds and particularly to bunk beds for camping.

2. Description of the Prior Art

For many years people have relied on camp cots for sleeping in tents while camping, and in military field work. These cots have typically consisted of a wooden or metal frame and a cot bed, typically made of canvas or cotton duck. They are designed to fold up for storage and transport. They have universally been made in single height configurations. Children often prefer bunk beds and, where families are concerned, efficient use of space in a tent is important. However, presently there are few options for stacking camp cots. One such example is the "Disc-O-Bed Cam-O-Bunk Xl Cot", which is a modified structure that ties two single cots together to make a bunk bed. The two cots can be used a singles or as a bunk bed. however, this is not a true dedicated bunk bed system.

Therefore, a dedicated bunk bed cot system is needed to accommodate those campers that wish to have dedicated bunk beds for their children, or for others.

BRIEF DESCRIPTION OF THE INVENTION

The instant invention solves this problem. In one embodiment, the invention is a portable, easy to assemble, camp bunk bed that is designed to be used with any camp cot bed that uses 0.375-inch diameter support pins, and has a width of 28 or 32 inches. The system features 2 frame assemblies, each frame assembly consists of 2 vertical stanchions and 2 lateral support rods. The vertical stanchions each have two cot bed support blocks with longitudinal support pins installed. Each stanchion has two 1-inch diameter holes drilled at precise locations and match drilled to accommodate the lateral support rods. One stanchion of the set also has a lateral tension stop installed which provides the lateral rod a base to press against when tightening.

The lateral support rods have a tensioner installed on one end, which allows the user to increase the overall width of the stanchions. The ability to increase stanchion width allows the user to compensate for small variations in cot width upon assembly. This feature also allows the user to adjust the cot to desired firmness. Assembly is accomplished by placing the stanchion with the tension stop on the ground and the non-tensioner end of the rods are placed in the first stanchions 1-inch diameter holes. Then the second stanchion is placed on top of the rods while aligning the rods so that they slip into the 1-inch diameter holes, making sure the tension is at its lowest setting. Next, the second frame is assembled. The cots beds are installed onto the pins and then the tensioners are adjusted to desired positions. Disassembly accomplished in the reverse order. In this embodiment, the frame is secured with hook and loop type fastener straps.

In the preferred embodiment, a modified cot that it is designed specifically for the preferred bunk bed system is used. In the preferred embodiment the tension assemblies of the first embodiment are no longer needed. This embodiment also eliminates the straps, using a new fastening system for the cot and has modified rails. Finally, adapter pegs are provided to allow the bunk bed to be converted to a singe cot, if desired.

DETAILED DESCRIPTION OF THE INVENTION

Figure 1:
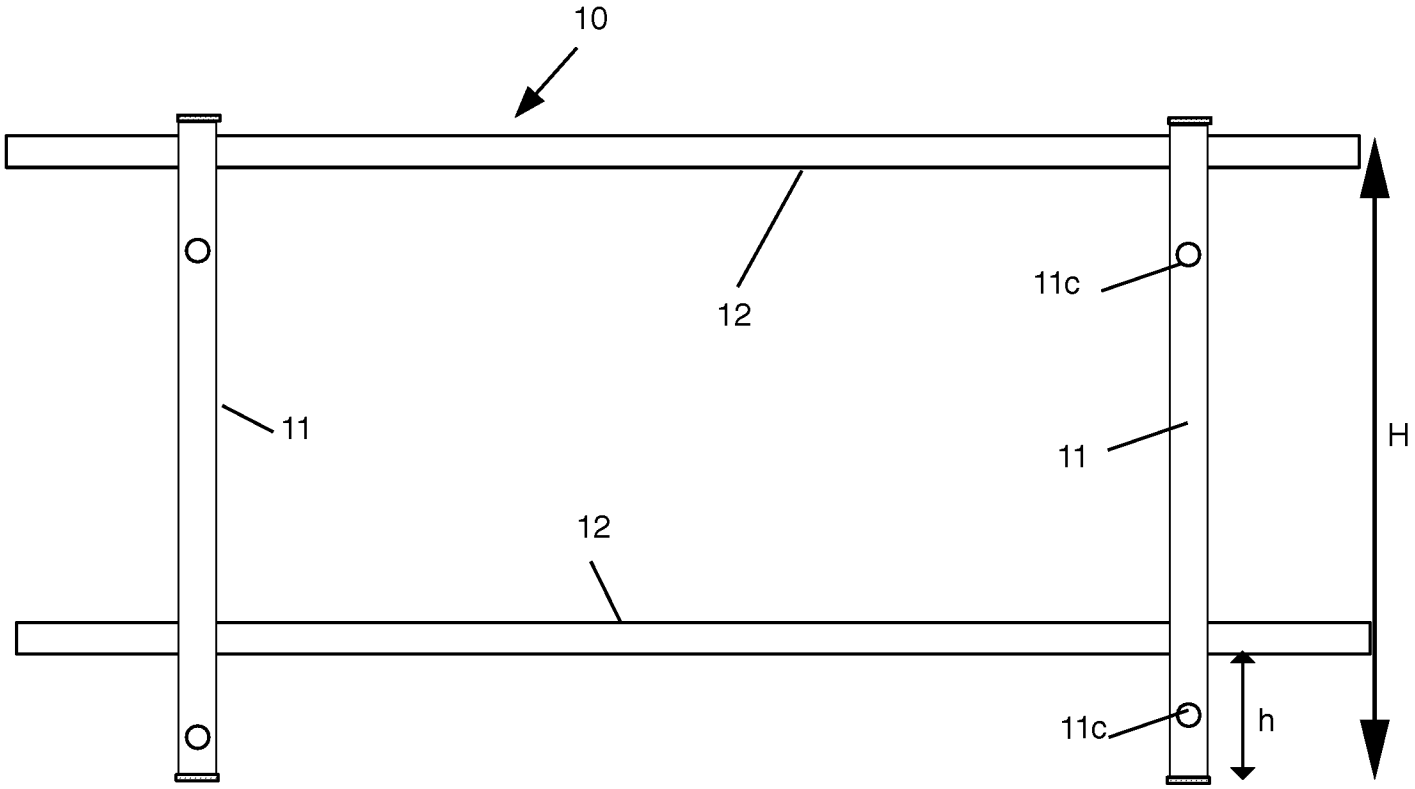
FIG. 1 is a side view of the first embodiment of the assembled bunk bed.
Figure 2:
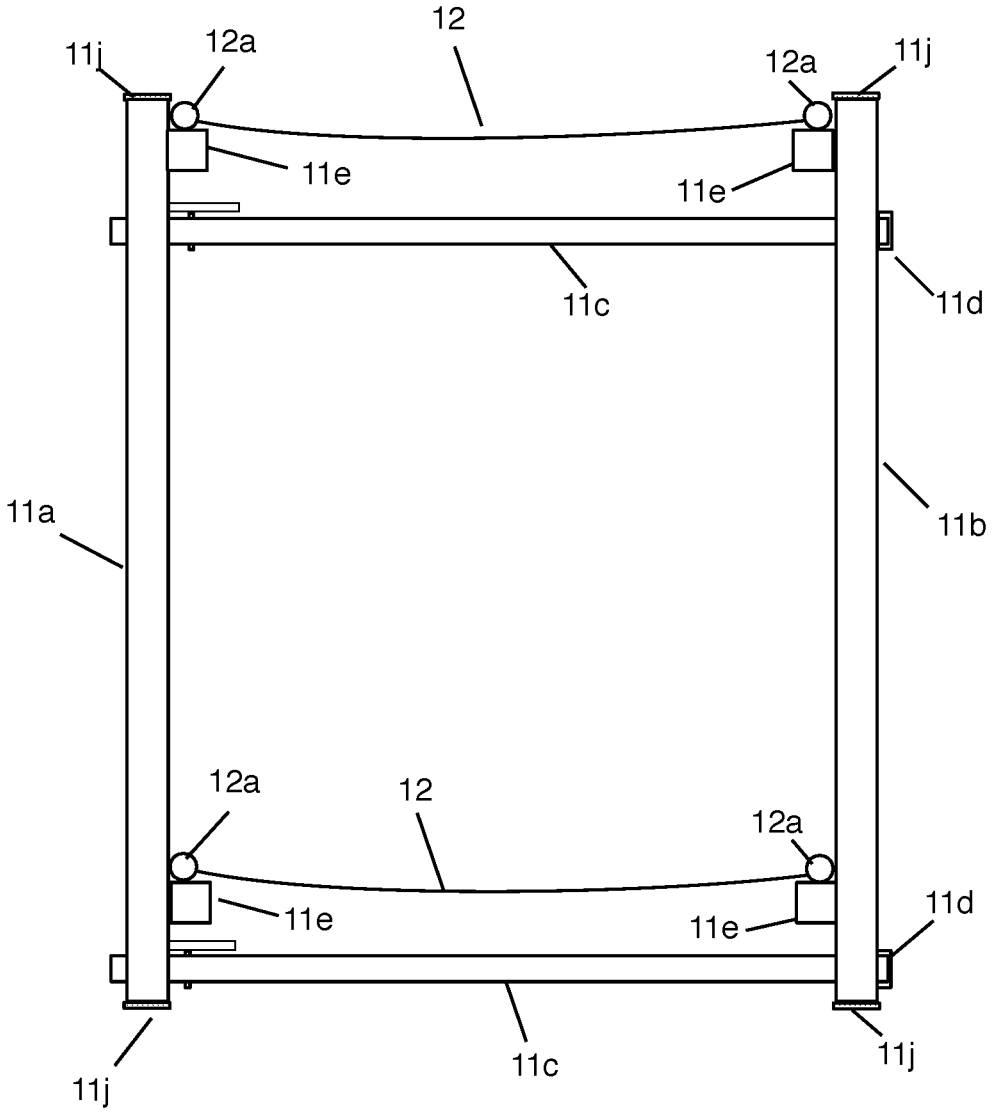
FIG. 2 is an end view the first embodiment of the assembled bunk bed.
Figure 3:
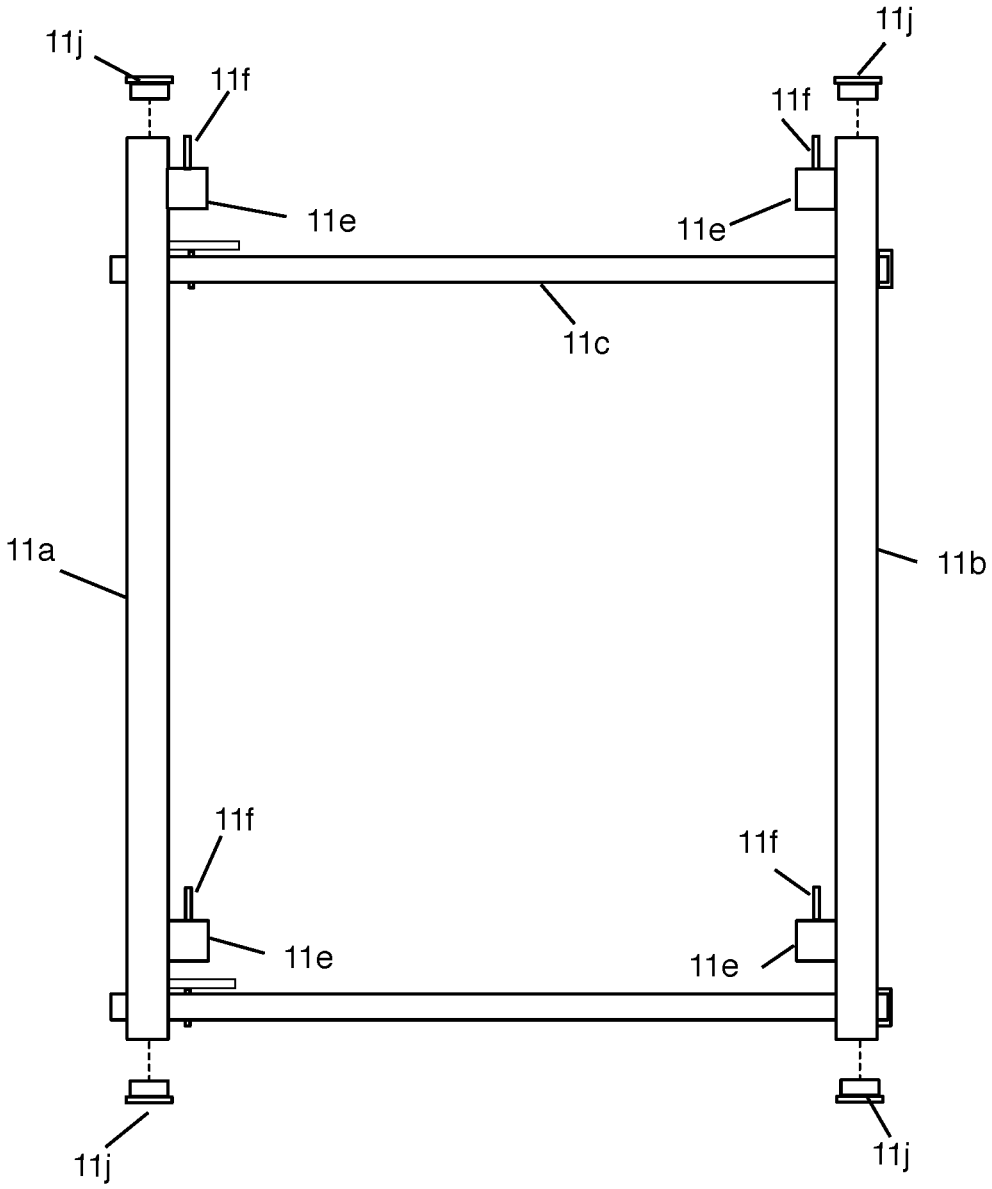
FIG. 3 is an assembled view the first embodiment of the bunk bed frame, with the cot beds removed.

Referring now to FIGS. 1, 2 and 3, a side view of the assembled bunk bed 10 of the first embodiment is shown in FIG. 1. The bunk bed 10 has two bunk frame assemblies 11 that support two cot beds 12, as discussed below. The cot beds are available commercially as part of a standard single cot such as those described in U.S. Pat. No. 5,109,556, or equivalent.

Figure 4:
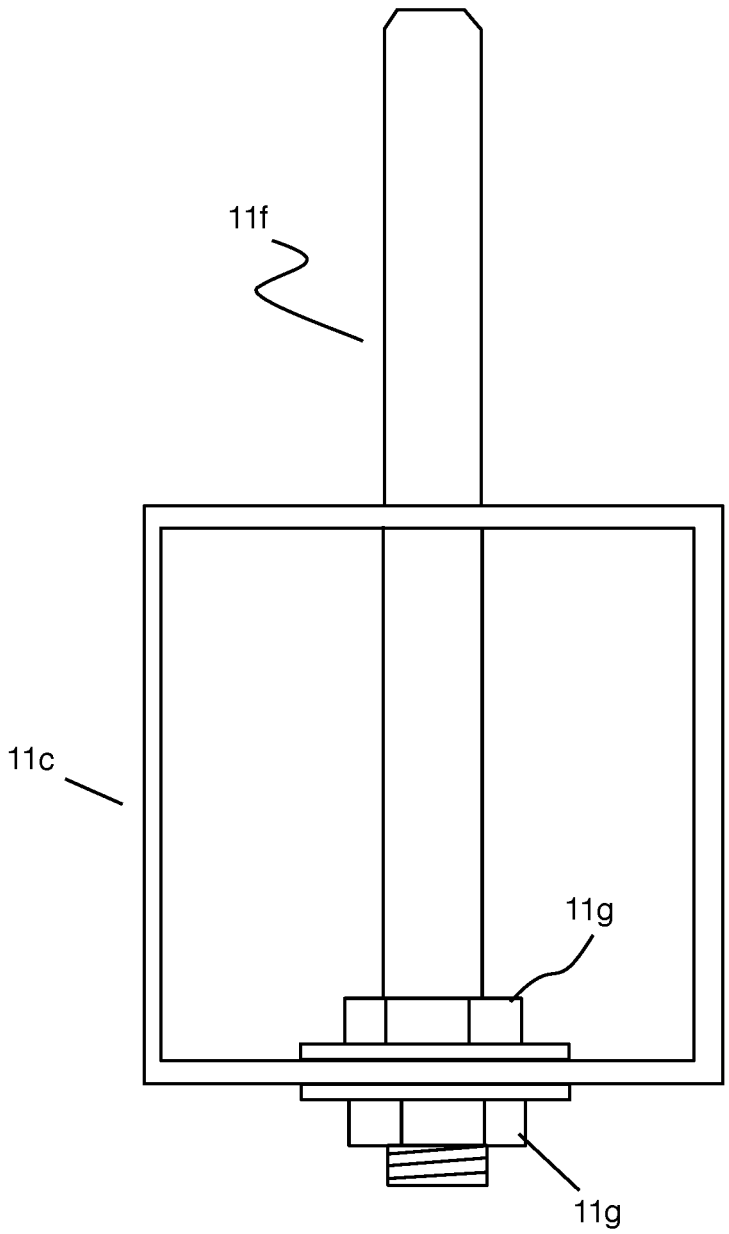
FIG. 4 is a side detail view the first embodiment of one of the support pin assemblies.

The cot beds 12 are designed to roll for storage and to be opened and stretched onto a frame for use. Note that in this embodiment, as in the preferred embodiment, the overall height of the bunk beds H is 34.5 inches, and the height above the ground h is 8 inches. FIG. 2 is an end view of the assembled bunk bed of the first embodiment. Here, details of the bunk frame assemblies 11 are shown as well as the two cot beds 12. Each of the two frames 11 has a pair of upright stanchions 11*a* and 11*b* (for left and right). Two support rods 11*c* are placed into the stanchions 11*a* and 11*b* as shown. As discussed below, the right stanchion lib has a tension stop 11*d* to keep the rod in place and to allow the tension system to operate, as discussed below. Each stanchion has a pair of support blocks lie that form part of the support pin assembly (see FIGS. 3, 4 and 5). The cod beds 12 have side rails 12*a* that have holes that align with the pins such that when the cot beds are installed, they are held securely in the frame. As discussed below, there is a tensioning system 14 that allows for slight variations in the width of the cot beds as well as acting to tighten or loosen the cot bed to adjust the firmness of the cot bed. Finally, the ends of the tubes 11*a* and 11*b* are sealed with plastic caps 11*j*. The end caps prevent the tubes from pushing into the ground when the bed is set up as well as finish the look of the tubes. FIG. 3 is an assembled view of the bunk bed frame, with the cot beds removed. In this figure, the pins 11*f* are visible. These pins support the cot bed side rails 12*a* as discussed above. Note that the end caps 11*j* are shown exploded. Each end cap has an insert portion and a cover portion. The insert portion is pushed into the tubing and the cover portion abuts against the tubing (as shown in FIG. 2) FIG. 4 is a side detail view of one of the support pin assemblies. Each of the support pin assemblies 11 has support blocks 11*e*. In the preferred embodiment, the support blocks are made of 1.5-inch square aluminum tube having a thickness of 0.125 inches. The support block is drilled to accept the support pin 11*f* as shown. The support pin is made of 0.375-inch diameter steel and is threaded on the bottom as shown. A pair of ⅜×16 nuts 11*g* secures the pin to the block.

Figure 5:
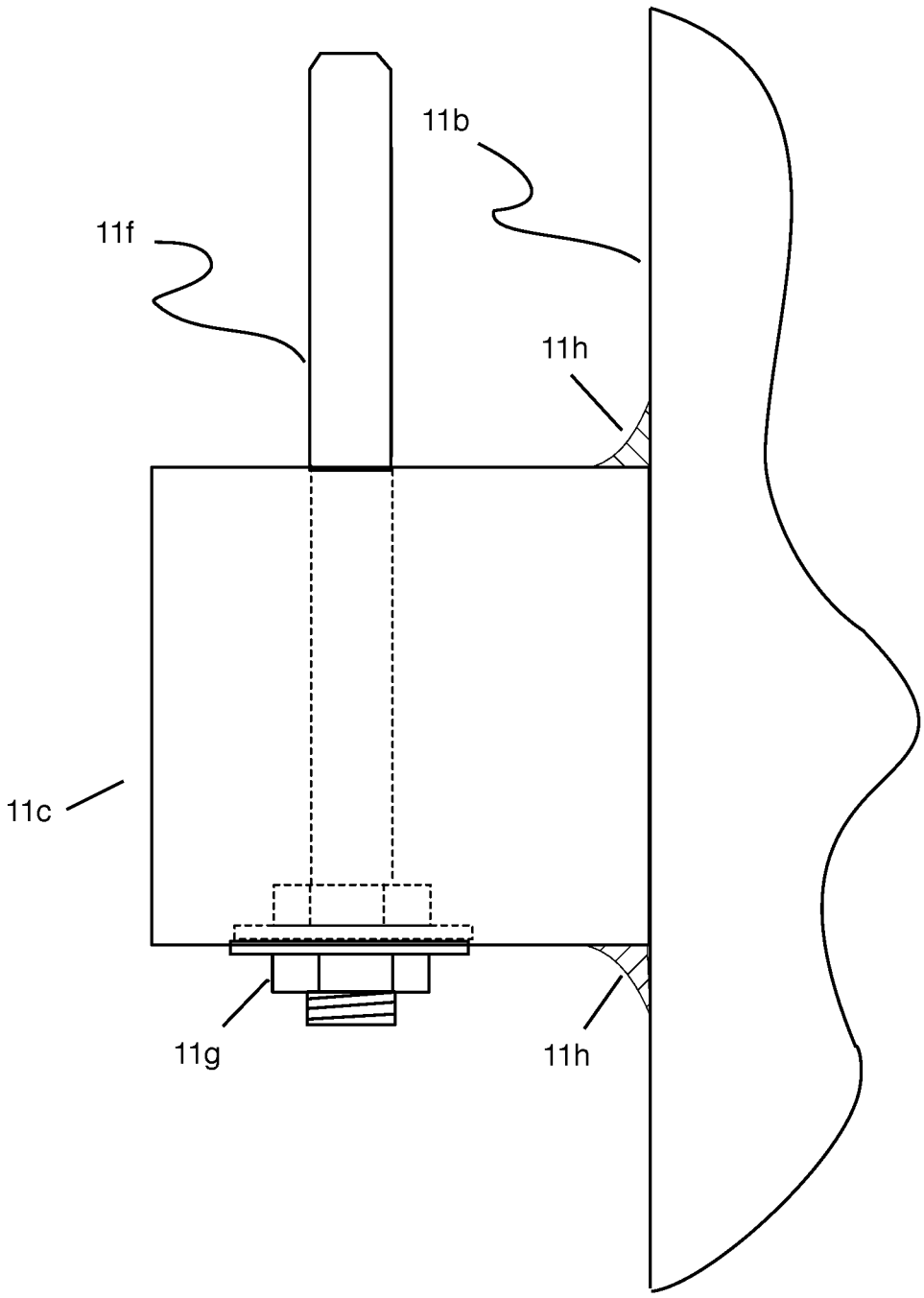
FIG. 5 is a front detail view the first embodiment of one of the support pin assemblies.

FIG. 5 is a front detail view of one of the support pin assemblies. Each of the support block assemblies is welded to the stanchions. Stanchion 11*b* shows the block is welded to the stanchion using 5356 aluminum fillet welds 11*h*.

Figure 6:
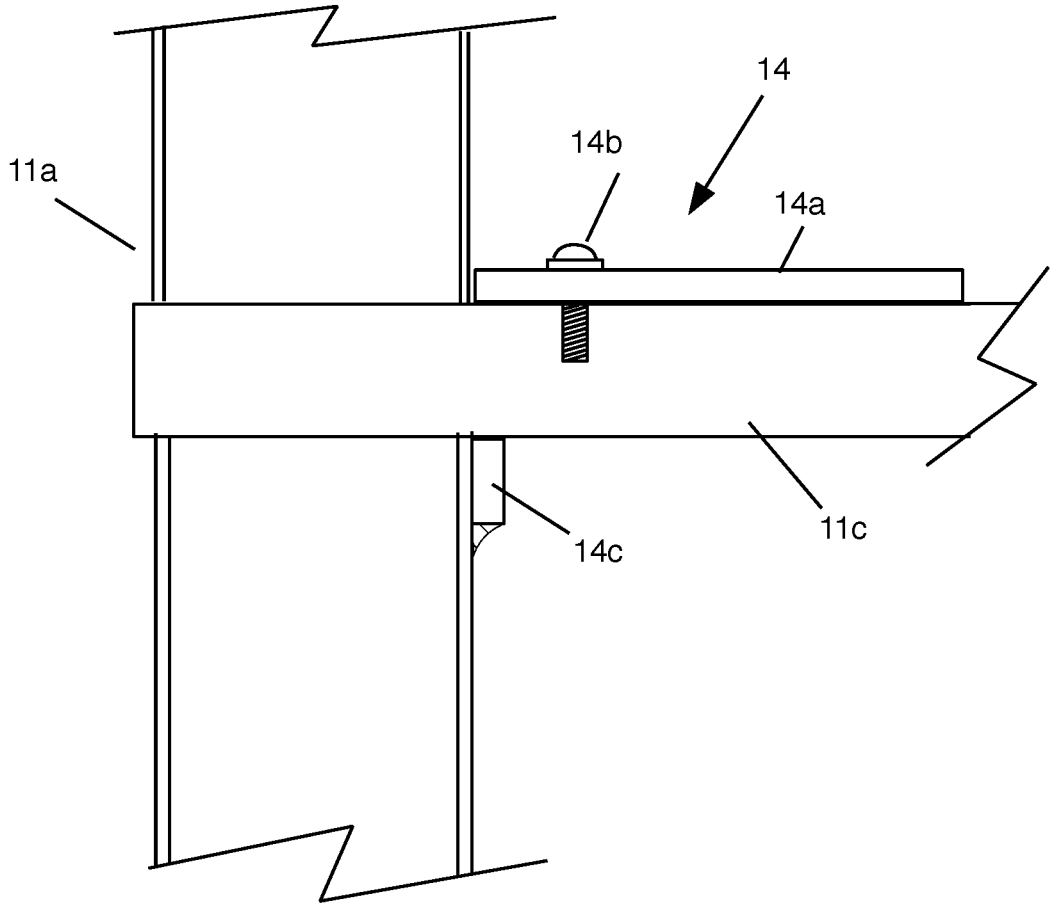
FIG. 6 is a side detail view the first embodiment of one of the tension lever and block assemblies.
Figure 7:
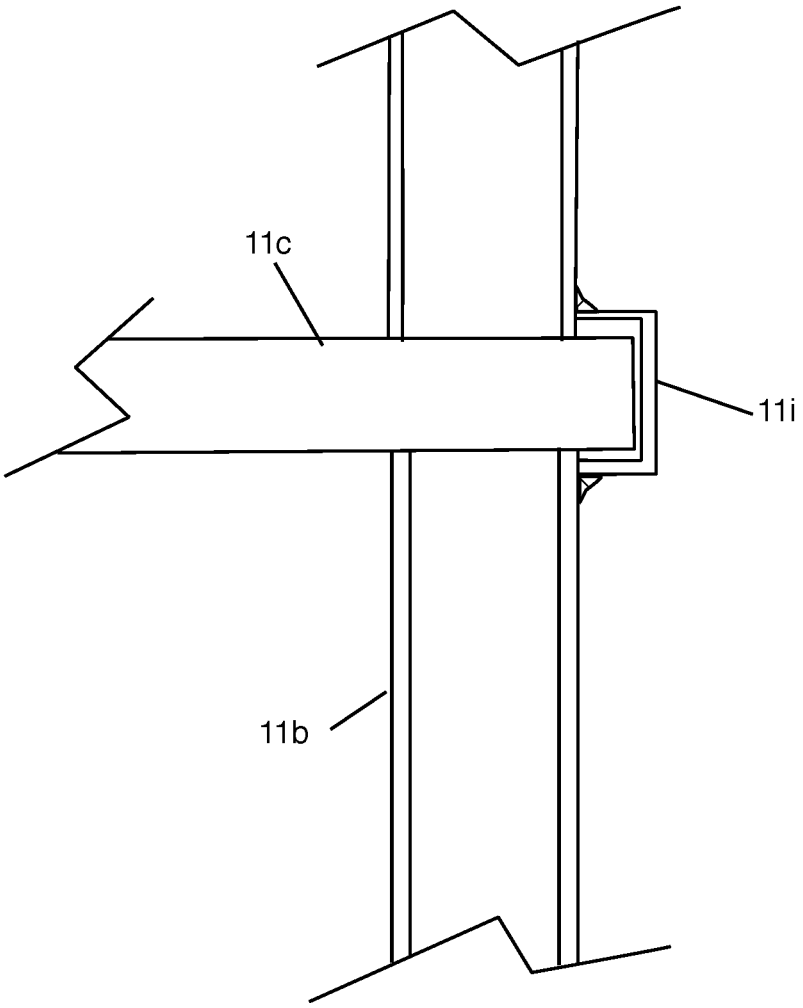
FIG. 7 is a detail view the first embodiment of one of the tension stops.

In this embodiment, a tensioning system is used to compensate for the possible variances in cot dimensions. FIG. 6 is a side detail view of one of the tension lever and block assemblies. When assembling the bunk bed, the tension lever 14*a* is rotated so that it is at right angles with respect to the support rod 11*c* (see FIG. 8). The tension lever 14*a* is held in place with a screw 14*b* as shown. In this embodiment, the screw 14*b* is a ¼×20 machine screw that is fitted into a threaded hole formed in the support rod 11*c*. If additional tension is needed, the lever can be rotated 90 degrees so that it parallel with the support rod 11*c*. That will expand the frame by 0.25 inches. If more tension is needed, the support rod 11*c* can be rotated 180 degrees so that the tension lever 14*a* is below the support rod 11*c*. Now, when the lever is rotated, it contacts the tension block 14*c*, which provides for additional lateral movement of the frame. To provide the ability for the frame to expand, the opposite end of the support rod 11*c* must be blocked. This is achieved by using a tension stop. FIG. 7 is a detail of one of the tension stops 11*i*. The tension stop is formed of ½ inch×1½ inch 6061 aluminum channel 7 that is fillet wielded to the outside surface of the stanchion 11*b*. In use, the support rod 11*c* is simply placed in the stanchion 11*b* until it contacts the tension stop securely.

Figure 8:
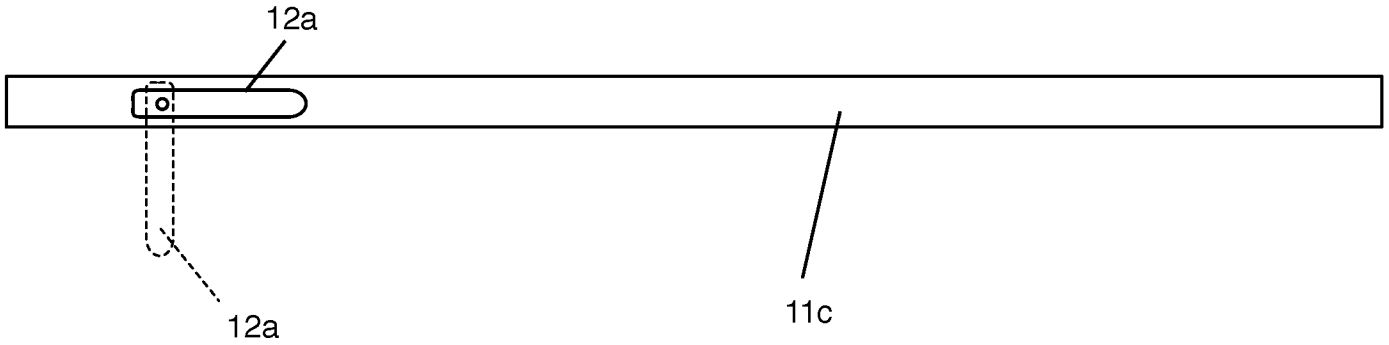
FIG. 8 is a top detail view the first embodiment of one of the support rods showing the tension lever.

FIG. 8 is a top detail view of one of the support rods showing the tension lever. Here, the support rod 11*c* is shown with the tension handle 14*a* in the parallel position and in dashed line, in the 90-degree position.

Once the frame is built, and the cots are installed, the bed is finished and can be used. There is a possibility, however, if sufficient end pressure is applied, the side rails 12*a* may disengage from the pins 11*f*. To prevent this, a hook and loop strap 11*k*, discussed below, is used.

Figure 9:
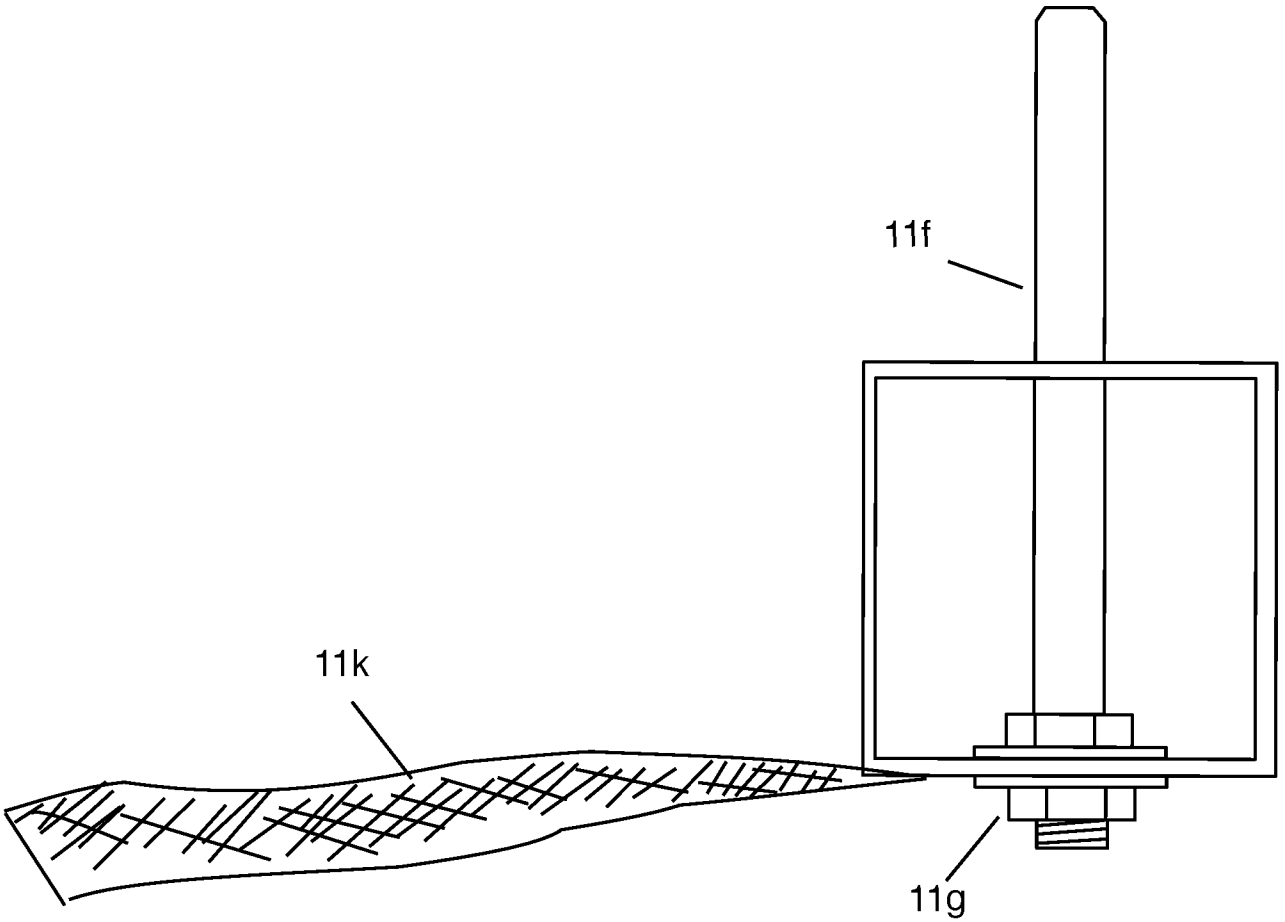
FIG. 9 is a detail view the first embodiment of a pin assembly with a piece of hook and loop fastener attached.
Figure 10:
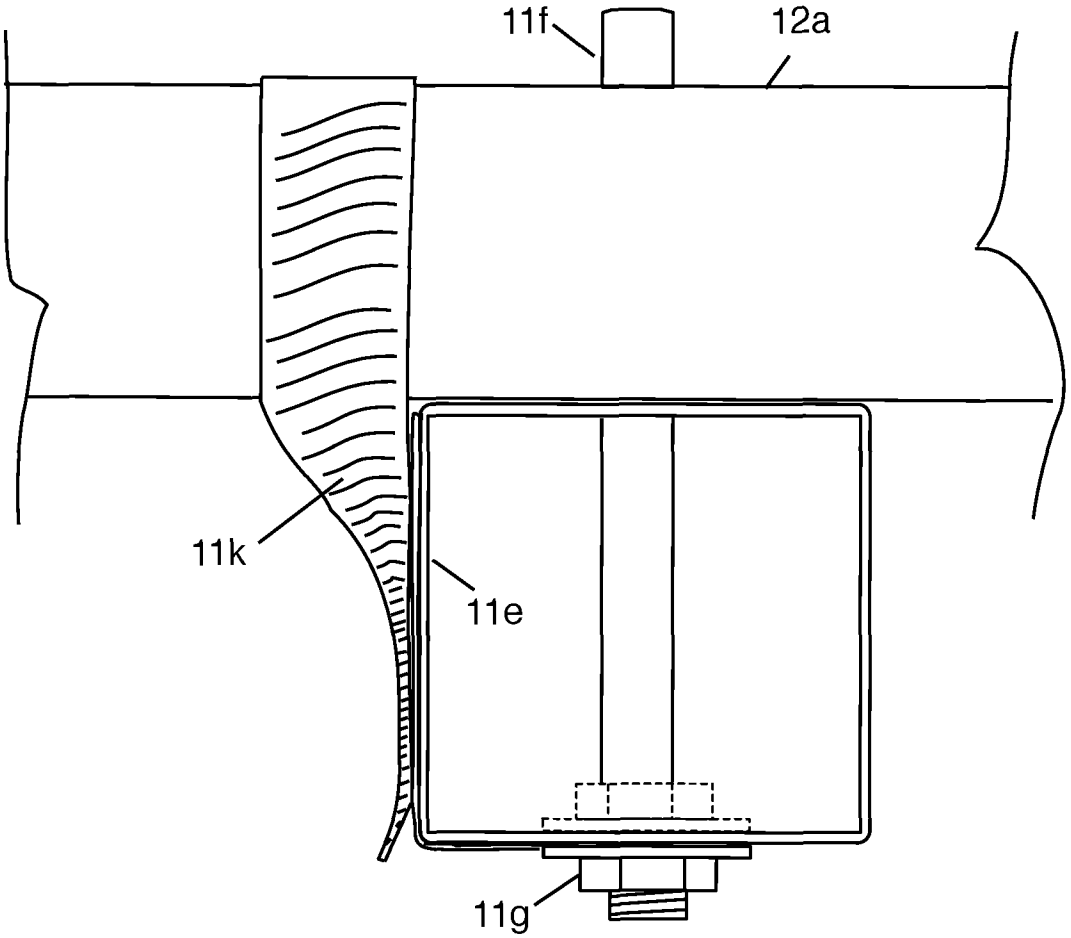
FIG. 10 is a detail view the first embodiment of the pin assembly showing the hook and loop fastener wrapped around the cot rails.

FIGS. 9 and 10 are detail views of construction of the first embodiment. FIG. 9 is a detail view is a pin assembly with a piece of double sided hook and loop fastener attached. Here, the pin assembly is as before. However, a length of hook and loop fastener 11*k* is attached. This is accomplished by removing the lower nut 11*g* and placing the hook and loop fastener 11*k* over the threaded portion of the pin 11*f* and replacing the nut 11*g*.

FIG. 10 is a detail view of the pin assembly showing the hook and loop fastener wrapped around the cot rails. With the cot side rail 12*a* in place, the user pulls the strap 11*k* along the side of the support block 11*e* and then the user wraps the strap 11*k* over the cot side rail 12*a* as shown and presses double sided the hook and loop strap 11*k* against the side of the support block 11*e* as shown. This ensures that the cot side rails remain in place on the frame despite pressures or movements of the frame.

Figure 11:
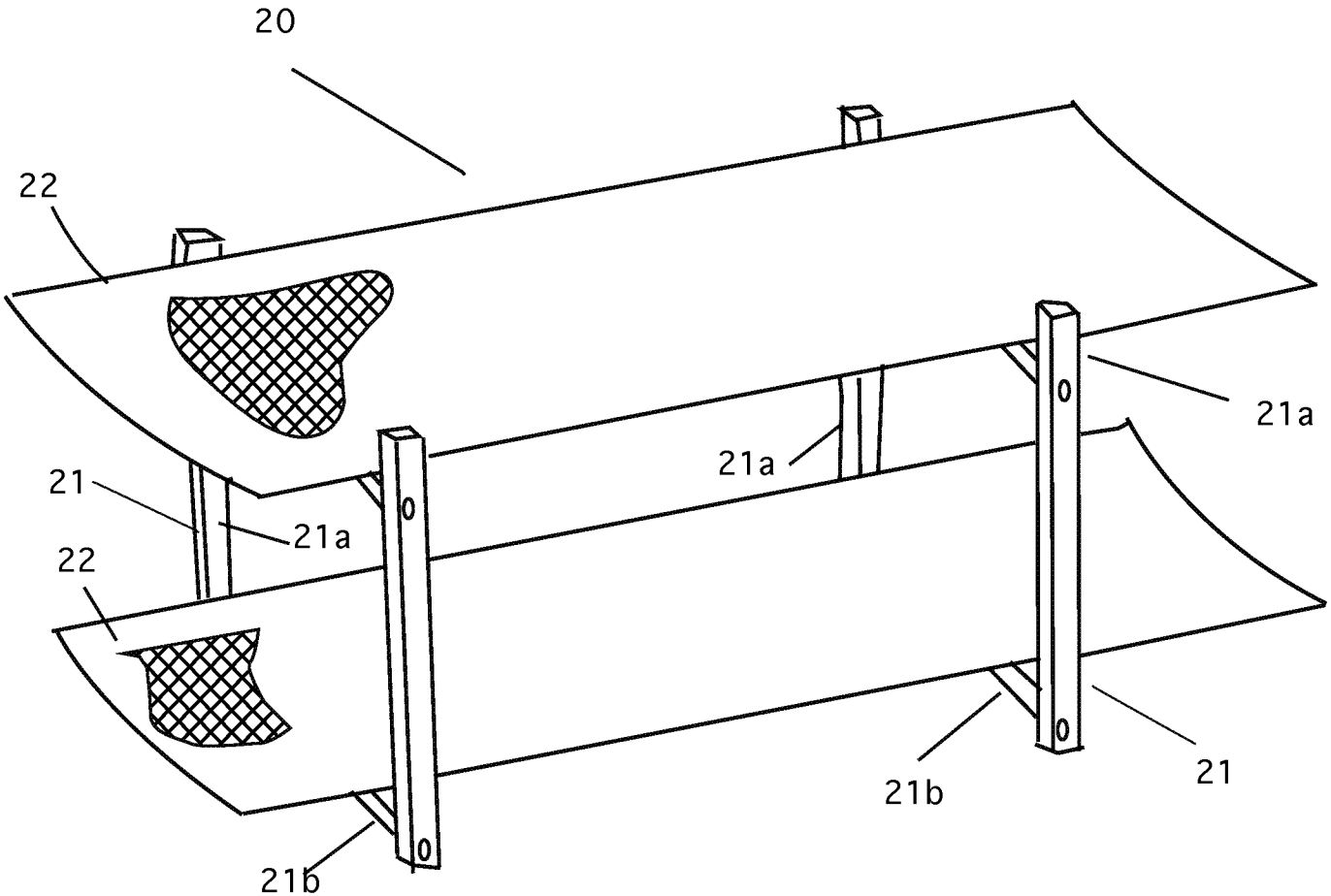
FIG. 11 is a perspective view of the preferred embodiment of the invention.

FIG. 11 is a perspective view of the preferred embodiment of the invention. In this view, the bunk bed 20 is shown. This bunk bed is similar to that of the first embodiment in that it has two frame assemblies 21 that include two vertical members 21*a* and two lateral supports 21*b*, two cot rail assemblies, and two cot assemblies 22.

Figure 12:
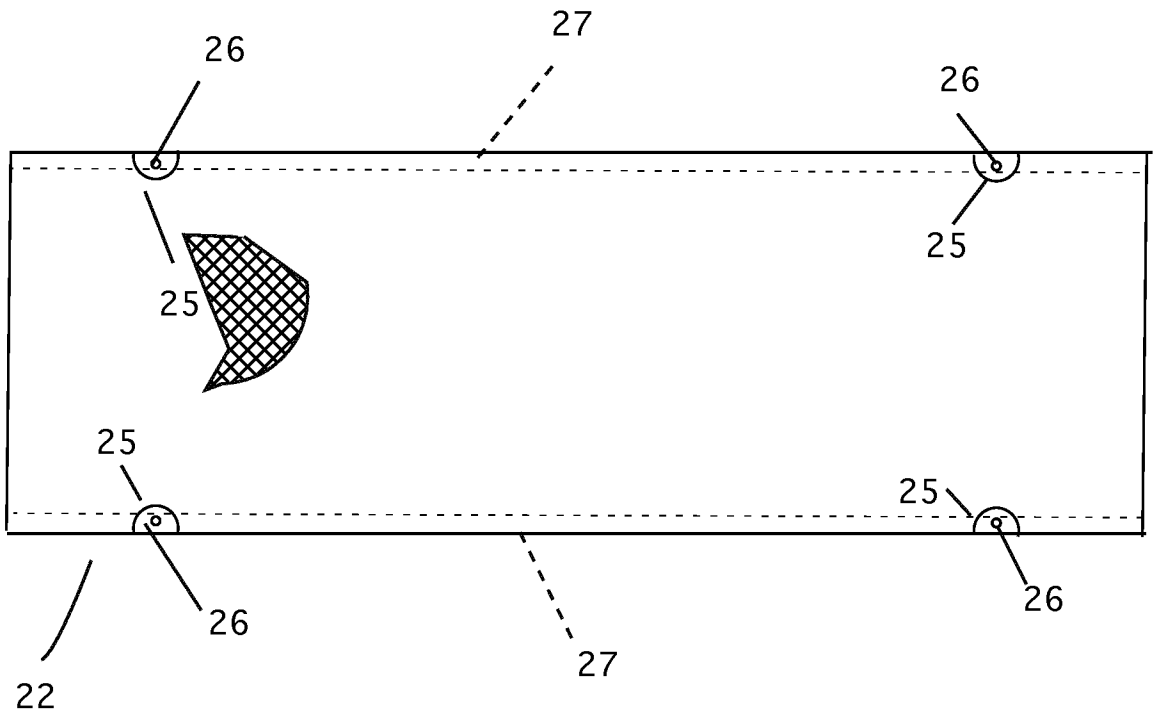
FIG. 12 is a top view of the preferred embodiment.

FIG. 12 is a top view of the preferred embodiment. Here, one of the cot assemblies 22 is shown. In the preferred embodiment, each cot assembly has a width of 29 inches and a length of 74 inches. Also in the preferred embodiment, the cot fabric 23 is 1300 denier PVC coated polyester. The ends of the cot 24 are folded into a one-inch hem. As shown, the cot fabric is cut at four places 25 to expose four holes 26 used to secure the cots to the frames, as discussed below. Note that the each cot has a pair of cot rail assemblies 27 (see also, FIG. 13) that run the length of the cot as shown.

Figure 13:
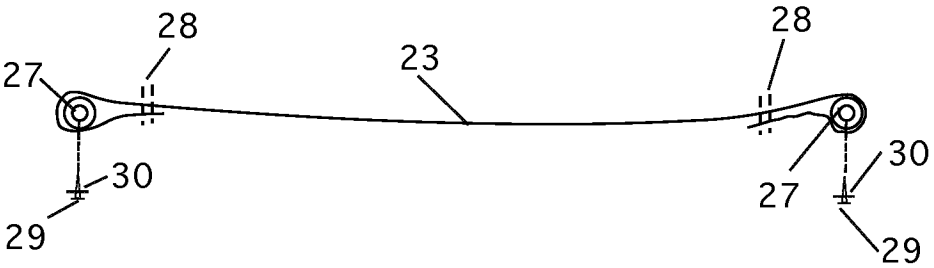
FIG. 13 is a cross-sectional view of the cot of the preferred embodiment.

FIG. 13 is a cross-sectional view of a cot of the preferred embodiment, taken along the lines 13-13 of FIG. 12. In this view, the cot fabric 23 is shown. The cot fabric 23 is folded over the cot rail assemblies 27 as shown and is double stitched using #135 polyester thread 28. Note too, that four number 12 screws 29 and washers 30 are used to secure the cot to the cot rail assemblies 27 with one screw being placed at each corner of the cot.

Figure 14:
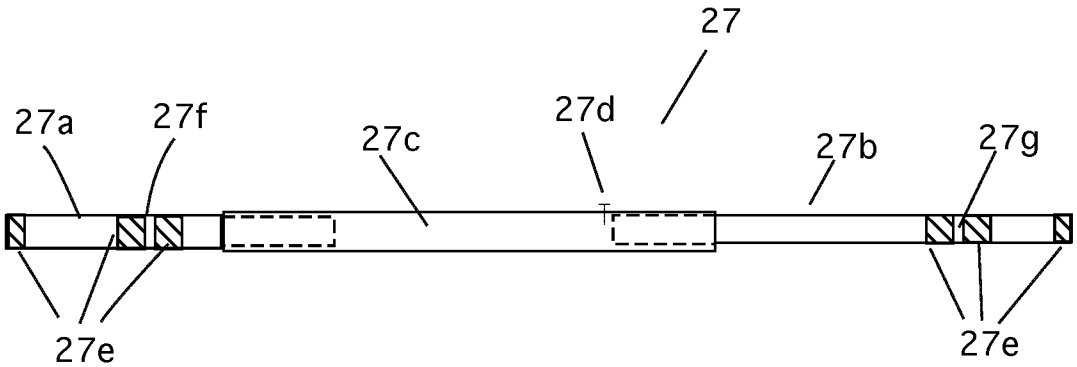
FIG. 14 is a front detail view of one of the cot rail assemblies of the preferred embodiment.

FIG. 14 is a front detail view of one of the cot rail assemblies 27 of the preferred embodiment. As shown in FIG. 14, the preferred cot rail assembly 27 uses two rails that are slid into a slider tube. The first is a short rail 27*a*; the second is a long rail 27*b*. These are connected together with a slider tube 27*c* as shown. A stop rivet 27*d* is placed in the slider tube as shown to restrict the inner movement of the long rail 27*b*. Both the short and long rails have high density polyethylene (HDPE) fillers 27*e*. Note too that the short rail 27*a* has a 0.375-inch diameter hole 27*f* and the long rail has a 0.375-inch diameter hole 27*g* at the locations shown.

Both the short rail and long rail are attached to the fabric cot member via the screws and washers 29 and 30 on each of the cot as shown in FIG. 13. Thus, the short and long cot rails become permanently attached to the cot.

The slider tube 27*c* only slides onto the long rail until the rivet 27*d* contacts the end of the rail, as discussed above.

When that occurs, the slider has slid off of the short rail enough to expose the 0.375-inch mount hole in the short rail. When fully assembled the slider can no longer retract back toward the short rail 27*a* because that rail it has been placed on the 0.375-inch mount stud of the frame assembly (see FIG. 15). Thus, when the cot is attached to the frame, the both the cot rail assemblies and the cot (via hole 26) are attached to the cot mount studs 21*c* (see FIG. 15 below).

The solid HDPE internal fillers 27*e*, into which the 0.375-inch mounting holes 27*f* and 27*g* are drilled, prevent the rail from potentially collapsing or deforming when the hand knobs are tightened. They also aid in the alignment/guiding of the stud fitting through the mount hole during assembly.

Figure 15:
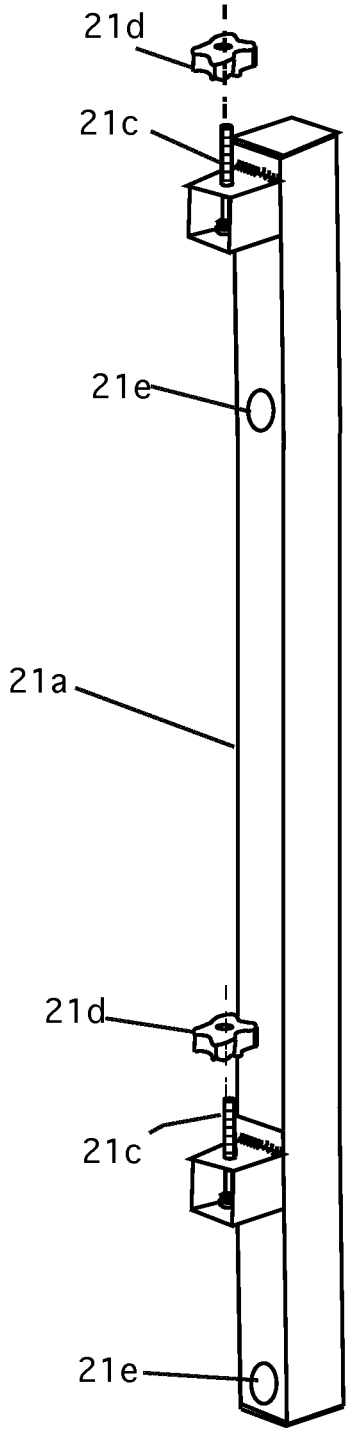
FIG. 15 is a detail perspective view of one of the vertical frame members of the preferred embodiment showing the cot mount studs and hand knobs.

FIG. 15 is a detail view of one of the frame rail vertical portions 21*a* of the preferred embodiment showing the cot mount studs 21*c* and hand knobs 21*d*. Each of the frame rail vertical portions 21*a* also has two holes 21*e* into which the ends of the lateral supports 21*b* are placed.

As discussed above, the cot (and the cot rail assemblies) has four 0.375-inch mount holes 26, which fit onto the 0.375-inch studs 21*c* on the frame assemblies. Once the cot is placed onto the frame studs the four hand knobs 21*d* are installed and tightened. This procedure is then repeated for the $2^{nd}$ cot. Tightening of the hand knobs provides longitudinal support for the bunk assembly.

Unlike the lateral supports for the first embodiment, which have a tension adjustment mechanism, the lateral supports for the preferred embodiment do not. This is because the frame of the first embodiment is designed to be used with any cot bed. As such, the lateral supports are adjustable to allow for different width cot beds. In the preferred embodiment, the cot beds are all made to the same specifications. Therefore, no such adjustments are needed.

Figure 16:
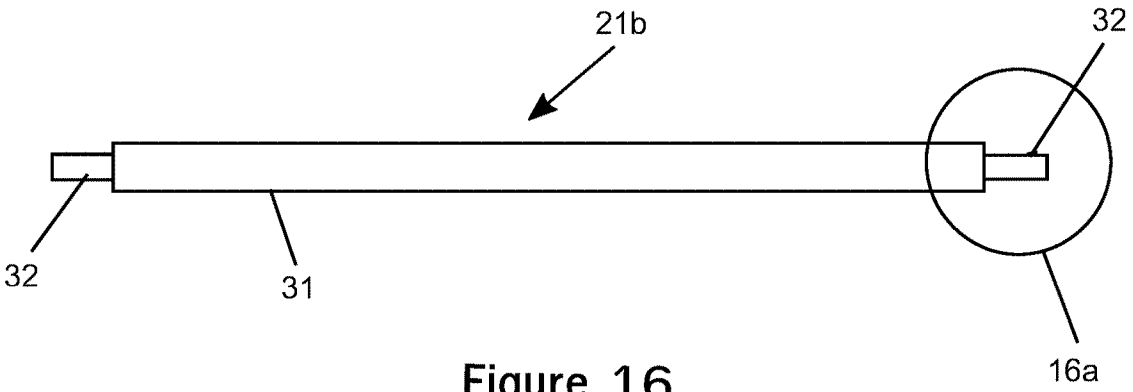
FIG. 16 is a side view of the lateral supports for the preferred embodiment.

FIG. 16 is a side view of the lateral supports 21*b* for the preferred embodiment. Here, the lateral supports have a center tube 31 that is 28.6 inches long (of course, these dimensions can be changed; however, this length works with the preferred cot width). In the preferred embodiment, the tube 31 is 1.250 inches in diameter having a 0.125 inch wall thickness and is made of type 6061 aluminum tube.

It has two end rods 32 that extend 2 inches from the end of the tube 31 as shown.

Figure 16A:
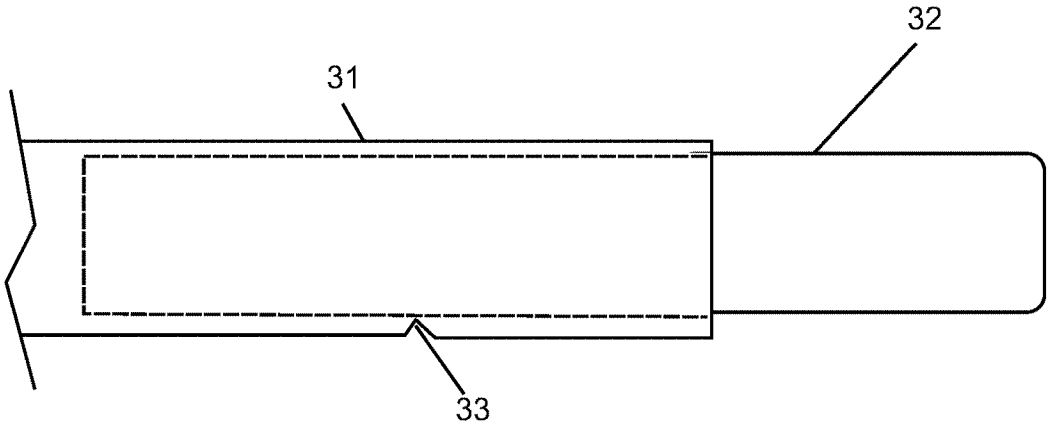
FIG. 16*a* is a detail portion of FIG. 16.

FIG. 16*a* is a detail portion of FIG. 16. Here, details of the end rods 32 are shown. The end rods 32 are preferably 1 inch diameter 6061 aluminum solid rods that are press fit 3 inches into the center tube 31. To further secure the rods in place, a safety crimp 33 is formed in the center tube as shown.

Figure 17:
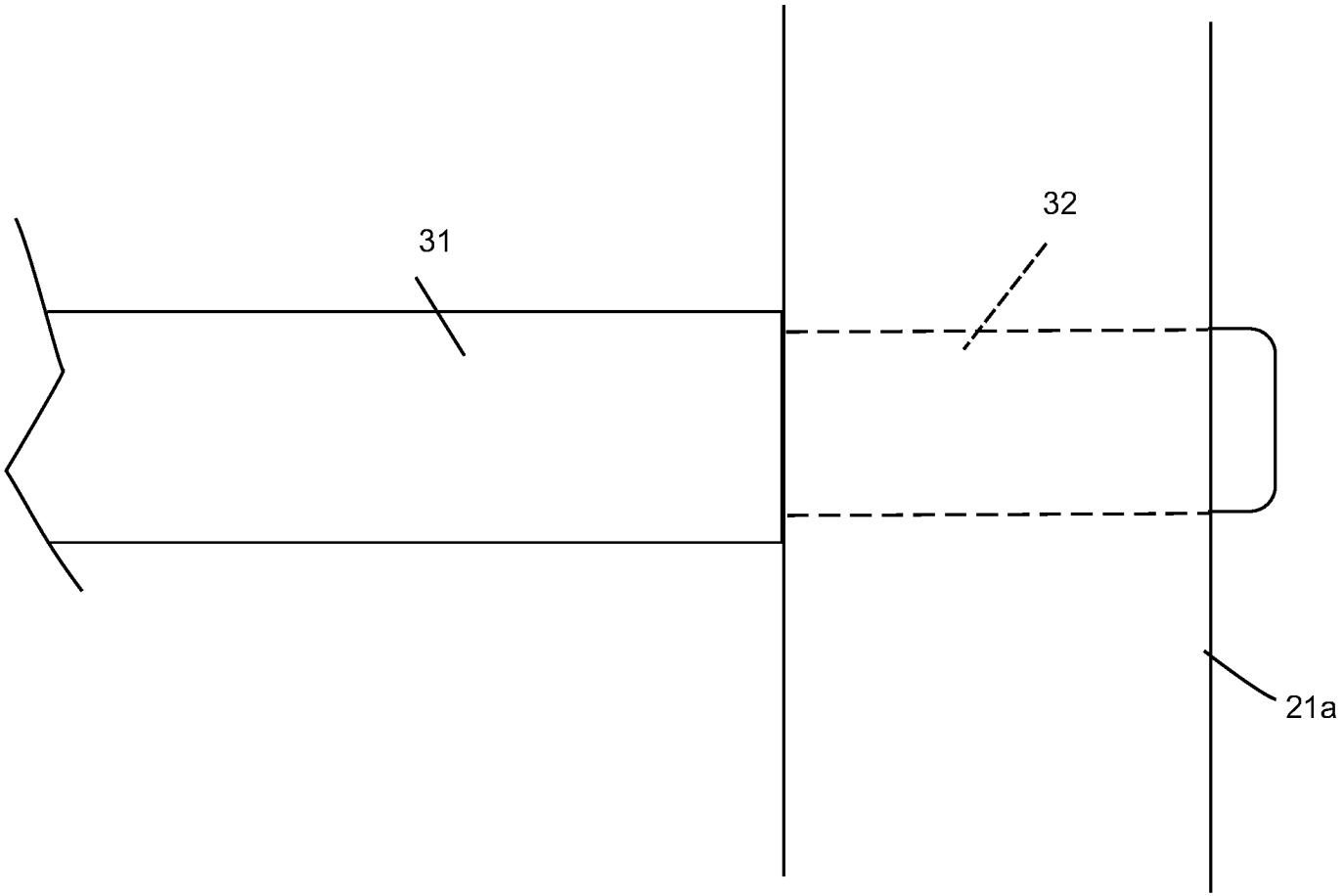
FIG. 17 is a detail showing one end of the lateral support installed in a vertical frame member.

FIG. 17 is a detail showing one end of the lateral support installed in a vertical frame member. In this figure, a vertical member 21*a* is shown with a lateral support 21*b* in place. Note that the end rod 32 is placed in the vertical member 21*a* until the center tube contacts the wall of the vertical member 21 as shown. In this way, the lateral support is locked into vertical member and there is no need for a lateral stop as in the first embodiment.

Figure 18:
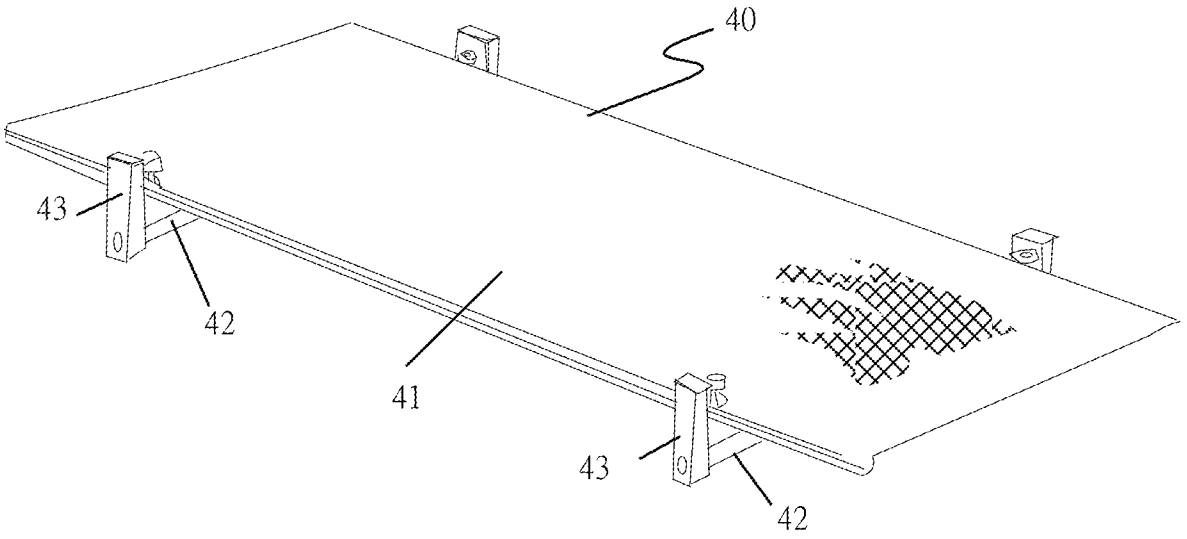
FIG. 18 is a perspective view of an assembled single cot of the preferred embodiment.

In the preferred embodiment, provision has been made to allow the cot portion to be used as a single cot, if desired. FIG. 18 is a perspective view of an assembled single cot 40 of the preferred embodiment. In this design, one cot with the cot rail assemblies 41 is used. Two lateral supports 42 are used as well. In addition, four single cot support posts 43 are used. The single cot is assembled as shown.

Figure 19:
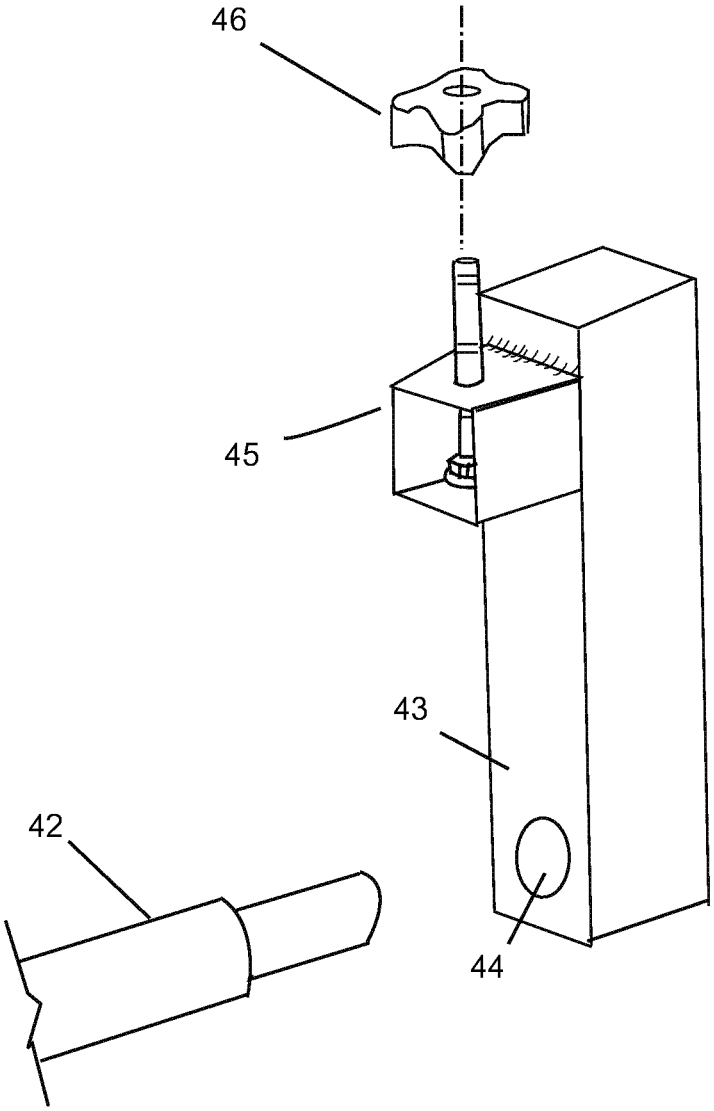
FIG. 19 is a detail view of the support post for the single cot option of the preferred embodiment.

FIG. 19 is a detail view of a support post 43 for the single cot option of the preferred embodiment. This post is shorter in the preferred embodiment—7.5 inches in height. A 1.015 inch diameter hole 44 is drilled near the bottom of the post as shown. This hole accepts the lateral support 42. A cot mount stud 45 and hand knob 46 are used as described above.

In use, the single cot assembly is identical to that of the bunk bed-without the upper bunk and associated structure and hardware.

Both embodiments are designed to disassemble for transport and storage. Each kit consists of two cot assemblies, two frame assemblies and two carrying pouches.

For the preferred embodiment, the bunk is divided between two carrying bags, each bag holding one cot and one frame assembly. For the preferred embodiment, after removing the contents of the bags, the frame is assembled by placing the two lateral rods into the 1-inch holes on a vertical stanchion. The second vertical stanchion is then placed onto the other end of the lateral rods. The lateral rods fit in the 1-inch hole is a precise fit and provides lateral support. The second frame assembly is assembled in the same manner.

The cots are then unrolled. The center slider tube is slid to one end, making all three cot tubes rigid. This procedure is done on both rails of each cot assembly.

The cot itself has four 0.375-inch mount holes which fit onto the 0.375-inch studs on the frame assemblies. Once the cot is placed onto the frame studs the four hand knobs are installed and tightened. This procedure is repeated for the second cot. Tightening of the hand knobs provides longitudinal support for the bunk assembly.

The carrying bags can then be installed on the frames, using the attached hook and loop fastener straps. The bags can then used for storage of the user's personal items.

As noted above, the bunk bed has an option to be used as a single cot. This is achieved by using the optional single leg kit. This kit consists of four 7.5" legs. These legs have the same precise holes for lateral rod engagement. The legs also have the same cot support block and 0.375-inch cot mount studs with hand knobs. A single cot is constructed by using two lateral rods, and one cot from the bunk bed assembly. Lateral and longitudinal support is achieved using the same methods as the bunk assembly.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A camp bunk bed comprising: a) a pair of free-standing frame assemblies, each of said pair of free-standing frame assemblies includes: i) a pair of vertical members each of said vertical members including a pair of mounting holes formed therein and two mounting lugs thereon and further wherein said mounting lugs are vertically spaced apart; ii) a pair of lateral supports, each of said lateral supports having a first end and a second end, and further wherein, said first end of one of said pair of lateral supports being positioned in one of said pair of mounting holes in one of said pair of vertical members, and said second end of one of said pair of lateral supports being positioned in the other of said pair of mounting holes in the other of said pair of vertical members such that the ends of said pair of lateral supports extend outside of said vertical members; iii) and further wherein the first end of the other of said pair of lateral supports being positioned in one of said pair of mounting holes in the other of said pair of vertical members, and said second end of the other of said pair of lateral supports being positioned in the other of said pair of mounting holes in the other of said pair of vertical members such that the ends of said pair of lateral supports extend outside of said vertical members: b) two cot assemblies, each of said two cot assemblies being attached to two of said mounting lugs on said vertical members; and c) a fastening system, installed on said vertical members to secure said two cot assemblies to said pair of frame assemblies, wherein said fastening system includes said mounting lugs.

2. The camp bunk bed of claim 1 wherein each of said the two cot assemblies comprise:

a) a fabric cot member having a length and a width and two parallel sides, said fabric cot member further having a plurality of holes formed therein, and further wherein each of said plurality of holes is aligned with one of said mounting lugs on said vertical members when said cot assembly is placed on said bunk bed; and b) a first side rail attached to one of said two parallel sides of said fabric cot member;

c) a second side rail attached to the other of said two parallel sides of said fabric cot member;

d) wherein said first and second side rails each having a plurality of holes formed therein, each of said plurality of holes being aligned with one of said mounting lugs on said vertical members when said cot assembly is installed on said bunk bed.

3. The camp bunk bed of claim 2 wherein said first and second side rails further comprise:

a) a short rail;

b) a long rail;

c) slider tube, having two ends and further wherein, said short rail in inserted into one of said two ends and said long rail is inserted in the other of said two ends; and d) a stop rivet, placed in said slider tube to restrict movement of said long rail within said slider tube.

4. The camp bunk bed of claim 3 wherein said short rail further comprises a high density polyethylene filler, located at the position of one of said plurality of holes formed in said side rails.

5. The camp bunk bed of claim 3 wherein said long rail further comprises a high density polyethylene filler, located at the position of one of said plurality of holes formed in said side rails.

6. The camp bunk bed of claim 3 wherein both said short rail and long rail are attached to the fabric cot member with screws and washers.

7. The camp bunk bed of claim 3 wherein each of said plurality of mounting lugs is threaded.

8. The camp bunk bed of claim 7 further comprising a plurality of hand knobs, each of said plurality of hand knobs being threadably secured to one of said plurality of mounting lugs.

9. The camp bunk bed of claim 1 wherein the pair of lateral supports comprise:

a) a first end rod;

b) a second end rod; and c) center tube.

10. The camp bunk bed of claim 9 wherein the first and second end rods are press fit into said center tube.

11. The camp bunk bed of claim 9 wherein the center tube further includes a safety crimp, formed in the center tube.

12. The camp bunk bed of claim 1 wherein each of said pair of lateral supports further includes a tension lever, rotatably installed on said lateral support.

13. The camp bunk bed of claim 1 further comprising:

a) at least four short legs, each of said short legs having a hole formed therein to receive one end of one of said lateral supports such that one lateral support engages two of said four short legs and a second lateral support engages the other two of four short legs, and each of said short legs also having a threaded mounting lug for receiving one of the two cot assemblies; and b) a hand knob for securing the one of two cot assemblies to said threaded mounting lug.

14. The camp bunk bed of claim 13 wherein each of said short legs is 7.5 inches in height.

* * * * *